US006881928B2

(12) United States Patent
Wong et al.

(10) Patent No.: US 6,881,928 B2
(45) Date of Patent: Apr. 19, 2005

(54) PERSONAL CARE APPLIANCE AND ATTACHMENT THEREFOR

(75) Inventors: Gilbert Wong, Bangkok (TH); Yukio Noguchi, Bangkok (TH)

(73) Assignee: Manica-Taiwan Inc., T.E.P.Z. (TW)

( * ) Notice: Subject to any disclaimer, the term of this patent is extended or adjusted under 35 U.S.C. 154(b) by 322 days.

(21) Appl. No.: 10/071,516

(22) Filed: Feb. 8, 2002

(65) Prior Publication Data

US 2003/0152373 A1 Aug. 14, 2003

(51) Int. Cl.[7] ..... A45D 20/10
(52) U.S. Cl. ..... 219/222; 392/385; 132/229
(58) Field of Search ..... 392/385; 34/96–97, 34/667; 132/226–229; 219/222–253, 553

(56) References Cited

U.S. PATENT DOCUMENTS 3,911,935 A * 10/1975 Wallin ..... 132/233
3,973,574 A * 8/1976 Minagawa et al. ..... 132/204
4,097,718 A * 6/1978 Weise ..... 219/222
4,109,667 A * 8/1978 Quirk ..... 132/233
4,147,927 A * 4/1979 Pirotte ..... 219/541
4,447,705 A * 5/1984 Bullock ..... 219/222
4,538,630 A * 9/1985 Henderson ..... 132/229
4,740,669 A * 4/1988 Takimae ..... 219/225
5,030,820 A * 7/1991 Gibbon ..... 219/759
5,077,461 A * 12/1991 Hasegawa ..... 219/553
5,124,532 A * 6/1992 Hafey et al. ..... 219/200
5,743,278 A * 4/1998 Ookura et al. ..... 132/210
5,941,253 A * 8/1999 Kaizuka ..... 132/232
6,064,051 A * 5/2000 Gray ..... 219/759
6,079,422 A * 6/2000 Drago et al. ..... 132/247
6,357,075 B1 * 3/2002 Kaizuka ..... 15/207.2
6,370,327 B1 * 4/2002 Seguy et al. ..... 392/407
6,378,225 B1 * 4/2002 Slingo ..... 34/97
6,640,049 B1 * 10/2003 Lee et al. ..... 392/385
6,798,982 B1 * 9/2004 Ryu et al. ..... 392/385

* cited by examiner

*Primary Examiner*—Robin O. Evans
*Assistant Examiner*—Vinod Patel
(74) *Attorney, Agent, or Firm*—Baker & McKenzie LLP

(57) ABSTRACT

Personal care appliances, such as hair care appliances, facial care appliances and body appliances, and attachments therefor are disclosed. The personal care appliances and attachments therefor according to the present invention are made of a blended material of thermo-resistant material and ion powders by injection moulding such that far infrared radiation and negative ions can be emitted naturally and continuously during operation. The present invention further provides individual hair arranging appliances for adjusting, cleaning or confining hair.

4 Claims, 6 Drawing Sheets

PERSONAL CARE APPLIANCE AND ATTACHMENT THEREFOR

BACKGROUND OF THE INVENTION

1. Field of the Invention

The present invention generally relates to personal care appliances and attachments therefor, more particularly, to personal care appliances and attachments therefor which emit far infrared radiation and negative ions naturally during operation.

2. Description of the Related Prior Art

It is well known that far infrared rays, electromagnetic waves and negative ions are beneficial to human health. Certain kinds hair care devices, such as hair dryers, are found to incorporate electrical ion-generators for emitting ions and electromagnetic waves for effective and fast blow drying and for styling human hair. Such devices conventionally utilize piezoelectric generators or voltage generators to actuate ion-generators to produce negative ions. However, devices incorporating piezoelectric generators have to be actuated manually by users and thereby are inconvenient and troublesome to use, while those incorporating voltage generators are not able to emit ions effectively since the voltage generated by voltage generators is relatively too low for ion-generators to operate effectively. Moreover, such devices may also generate excessive amounts of ozone which is harmful and hazardous to human health. In addition, conventional hair care devices with the above generators are relatively bulky and are therefore difficult to use.

It is known that certain particular compound materials which emits far infrared radiation and electromagnetic waves of certain wavelengths are applicable to hair dryers. For example, U.S. Pat. No. 6,205,674 discloses a hair dryer A (with reference to FIG. 1) with ceramic layers 33 and 41 coated onto heating element 3 and the inner surface of nozzle 4 respectively. Such ceramic layers 33 and 41 are composed of extreme infrared radiation material emitting powders and poly-element minerals powders. By heating the heating element 3, the extreme infrared radiation material powders emit extreme infrared radiation and the poly-element minerals powders emit electromagnetic waves with wavelengths of 4 to 14 $\mu$m. However, the ceramic coating layer applied on the heating element may be peeled off or be worn off due to the relatively high temperature raised on the heating element during operation of hair dryer. In addition, heat will accumulate where the darker ceramic coating material is applied likely resulting in damage to the heating element, and even the outlet part 2 of the hair dryer, commonly made of plastic, may easily soften or melt.

Accordingly, a need exists for an ion-emitting personal care appliance which is compact, lightweight and easy-to-use and which durably produces relatively highly charged negative ions.

SUMMARY OF THE INVENTION

The present invention is primarily introduced in order to solve the aforementioned problems involved in the personal care appliances according to the prior art.

It is therefore the principal object of the present invention to provide an ion-emitting personal care appliance, such as facial care appliances, hair care appliances and body care appliances, and attachments therefor which emits far infrared radiation and negative ions naturally and continuously during operation, and which are durable and easy to use.

To achieve the above object, the present invention provides a hair dryer comprising a housing, in which an air inlet, an impeller, a heating element and an air outlet are enclosed, wherein the housing is injection moulded of a blended material of thermo-resistant plastic material and ion-powders.

The present invention also provides attachments suitable for combination with a hair dryer or a hair curling iron wherein the attachments are made of a blended material of thermo-resistant plastic material and ion-powders by injection moulding.

The present invention further provides a hair curling roller having a hollow cylindrical shell, which is able to emit far infrared radiation and negative ions, wherein the cylindrical shell is made of a blended material of thermo-resistant plastic material and ion-powders by injection moulding.

The present invention further provides attachments for facial care appliances and for body care appliances wherein the attachments are made of a blended material of thermo-resistant material and ion-powders by injection moulding so as to emit far infrared radiation and negative ions during operation.

Furthermore, the present invention provides a hair arranging device for adjusting, cleaning or confining hair, wherein the device is made of a blended material of thermo-resistant material and ion-powders by injection moulding so as to emit far infrared radiation and negative ions during operation.

Other objects, features and advantages of the present invention will become readily apparent in view of the following detailed description of preferred embodiments and accompanying drawings.

BRIEF DESCRIPTION OF THE DRAWINGS

The present invention will become more apparent from the detailed description given hereinbelow when read in conjunction with the accompanying drawings, which are given by means of illustration only and thus are not limitative of the present invention, in which.

DETAILED DESCRIPTION OF THE INVENTION

In order to simplify the description of the present invention, several embodiments relating to hair care appliances and attachments therefor are illustrated hereinbelow and should not be deemed as limitations to the present invention.

Figure 1:
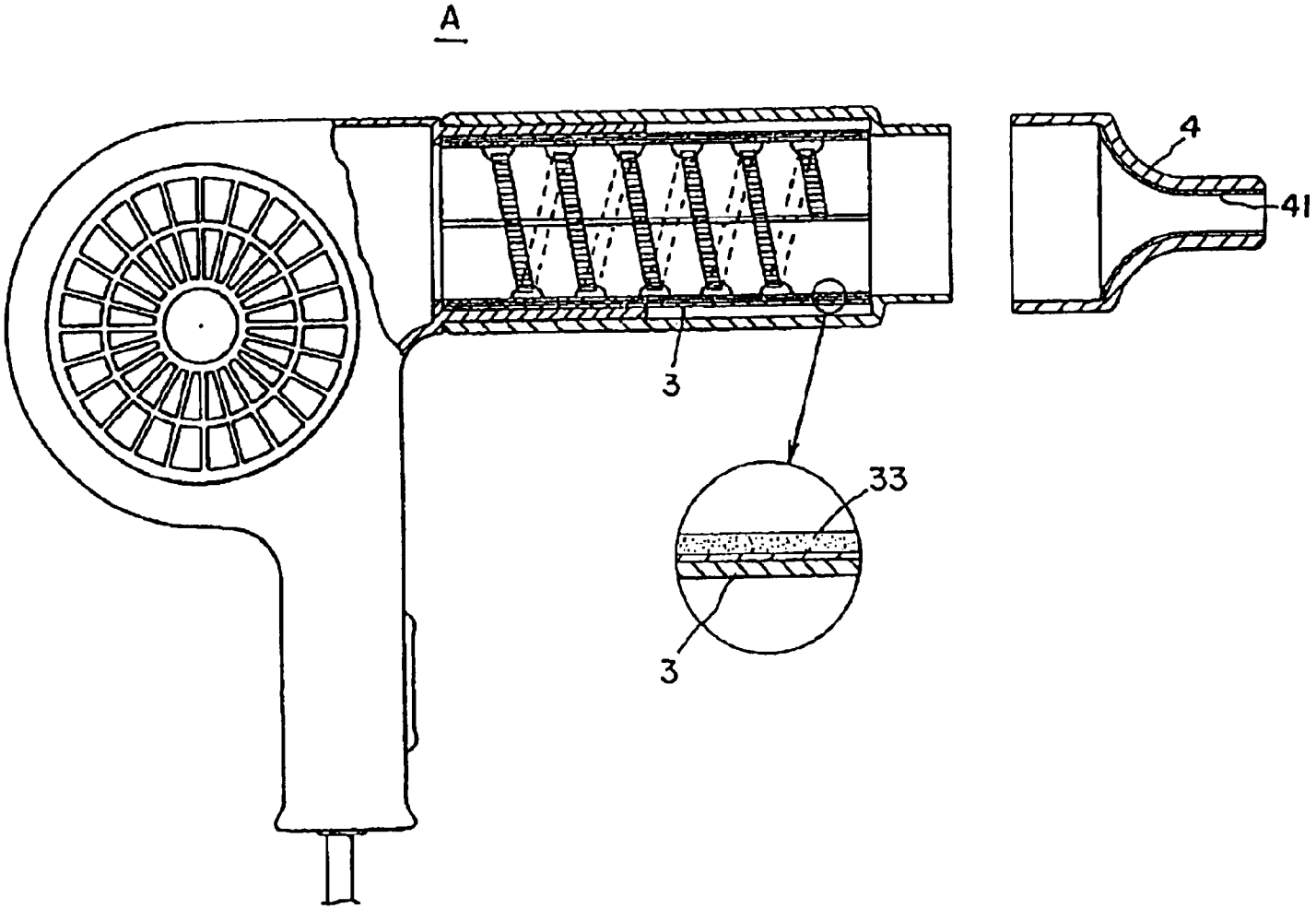
FIG. 1 is a sectional view of a hair dryer in the prior art.
Figure 2:
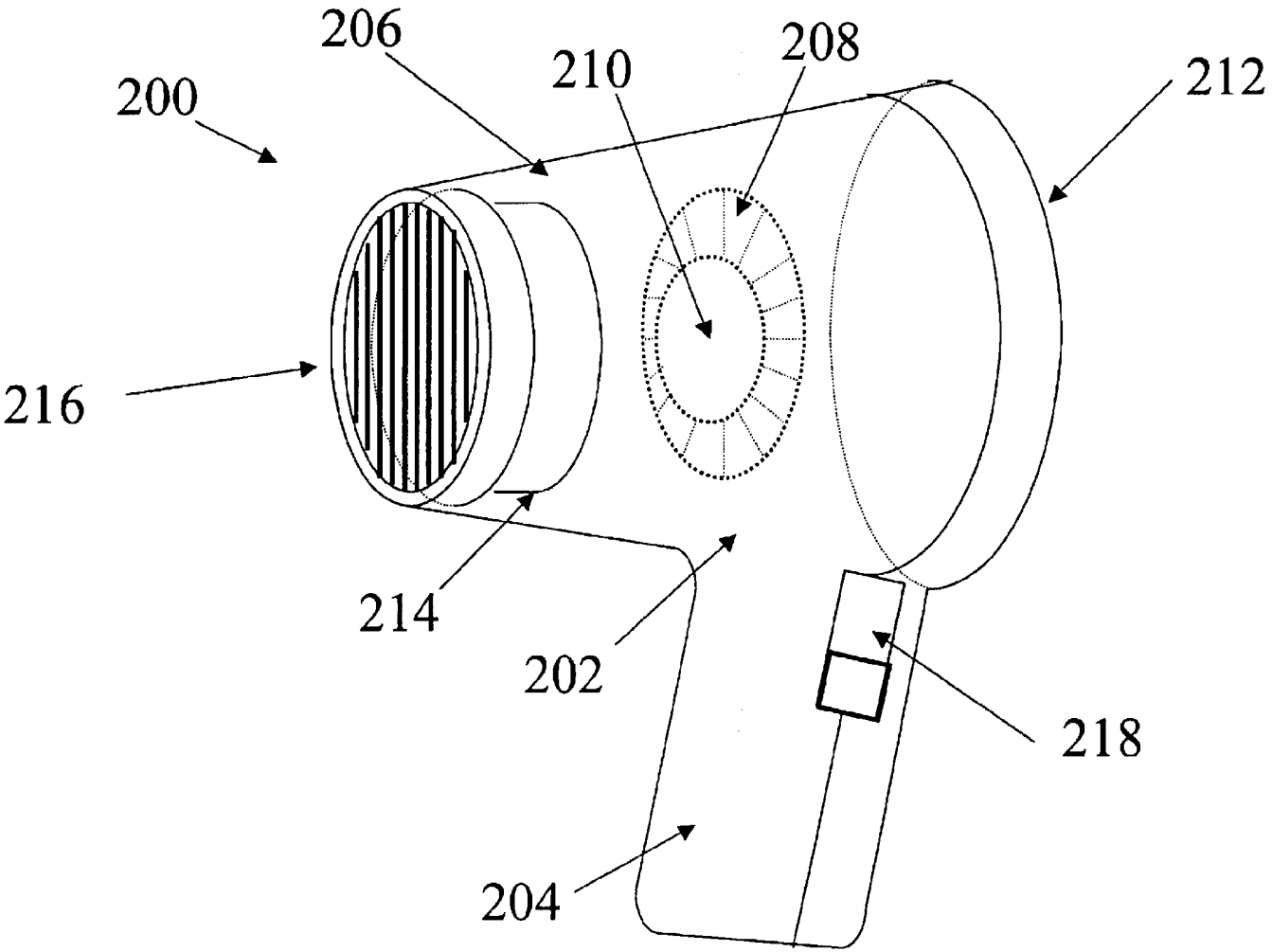
FIG. 2 illustrates a hair care appliance according to a first embodiment of the present invention.

With reference to FIG. 2, a hair dryer 200 according to a first embodiment of the hair care device of the present invention is shown. The hair dryer 200 includes a housing 202, which is composed of a handle portion 204 and a head portion 206. The head portion 206 encloses an impeller 208 activated by an electric motor 210 for forcing ambient air into the head portion 206 through an air inlet 212 and a heating element 214 for heating the air passing therethrough. The heated air subsequently leaves the head portion 206 through an air outlet 216. A switch 218 is provided on the handle portion 204 for controlling the speed of the electric motor 210 and turning on and off the heating element 214, and for controlling or providing any other function that a hair care appliance may have.

In order to provide far infrared radiation and negative ions during operation, the housing 202 of the hair dryer 200 is made of a blended material of thermo-resistant material and ion-powders by injection moulding or other suitable forming technology. The term "ion-powders" hereinbelow refers to any material in the form of powders which emits far infrared radiation and negative ions naturally, and the term "thermo-resistant material" refers to any material which is heat-resistant and electric-insulating, such as synthetic resin, thermoplastic resin and rubber-like flexible materials. According to a preferred embodiment of the present invention, the "ion-powders" is a blended mixture of powders including anhydrous silicon ($SiO_2$), aluminum oxide ($AL_2O_3$), iron oxide ($Fe_2O_3$), titanium oxide ($TiO_2$), calcium oxide (CaO), magnesium oxide (MgO), potassium oxide ($K_2O$), sodium oxide ($Na_2O$) and manganese oxide (MnO). The following chart shows the chemical composition and the weight percentage thereof of the "ion-powders" according to a preferred embodiment of the present invention.

| Chemical Composition | Weight Percentage |
|---|---|
| Anhydrous Silicon ($SiO_2$) | 82.25 |
| Aluminum Oxide ($AL_2O_3$) | 8.59 |
| Iron Oxide ($Fe_2O_3$) | 1.06 |
| Titanium Oxide ($TiO_2$) | 0.33 |
| Calcium Oxide (CaO) | 1.55 |
| Magnesium Oxide (MgO) | 0.37 |
| Potassium Oxide ($K_2O$) | 2.96 |
| Sodium Oxide ($Na_2O$) | 2.26 |
| Manganese Oxide (MnO) | 0.02 |
| 1 g LOSS | 0.61 |
| TOTAL | 100 |

The size of the ion-powders is also a very important design factor. In order to keep the contact area of the powders as large as possible so as to bring out the best performance, the present invention utilizes ion-powders having an average diameter of about 2.75 $\mu$m, and approximately all of the ion-powders are less than 10 $\mu$m in diameter. It is found that the ion-powders of the above composition and diameter emit 4000–6000 negative ions per cc according to the present invention.

In the present invention, certain weight percentages, preferably 3–5%, of ion-powders against the thermo-resistant material are used and mixed well therewith prior to the forming process, which in the preferred embodiment is by injection moulding. The negative ions emitted from the blended material of thermo-resistant material and ion-powders are measured roughly to be 100–200 negative ions per cc.

It should be noted that the above composition is only an illustrative preferred embodiment of ion-powders according to the present invention. Other compositions which may desirably emit far infrared radiation and negative ions are within the contemplation of the ion-powders of the present invention. Furthermore, the size of the ion-powders and the weight percentage thereof against the thermo-resistant material disclosed above are also for illustrative purposes only, and generally the ion-powders may be mixed into the thermo-resistant material to the extent that such composition amounts of ion-powders would not have significant deleterious effect on the performance of the thermo-resistant material.

Figure 3:
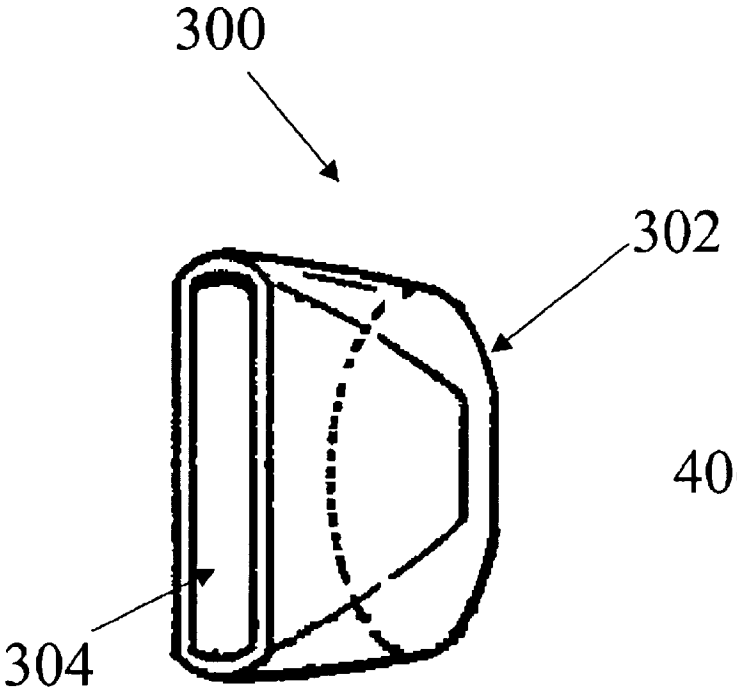
FIG. 3 illustrates an attachment adapted for combination with the hair care appliance of FIG. 2.

In order to provide further functions such as hair styling, various attachments are designed for being releaseably attached to a hair care appliance according to the present invention. With reference to FIG. 3, a nozzle 300 adapted for combination with a hair care appliance is shown. The nozzle 300, which has a truncated conical shape, is utilized to concentrate the air flowing out from the air outlet of a hair care appliance (not shown). The nozzle 300 comprises a connecting portion 302, which is configured to releaseably fit with an air outlet of a hair care appliance, such as the air outlet 116 shown in FIG. 2. The air, cold or heated, from the air outlet of a hair care appliance is introduced into the nozzle 300 and then flows out of the nozzle 300 through an opening 304. The opening 304 shown has a smaller cross-section area than the air outlet of the hair care appliance such that the air from the air outlet is concentrated and accelerated thereby drying the hair faster. Alternatively, the opening may have a larger cross-section area than that of the air outlet of the hair care appliance for distributing the outflowing air more widely.

The nozzle 300 according to the present invention is made of the blended material described above into a single piece by injection moulding or other suitable forming technology such that it emits far infrared radiation and negative ions into the hair and scalp during operation when it is attached to a hair care appliance, thereby causing the hair to be dried more effectively and rapidly and to become softer and shinier.

Figure 4:
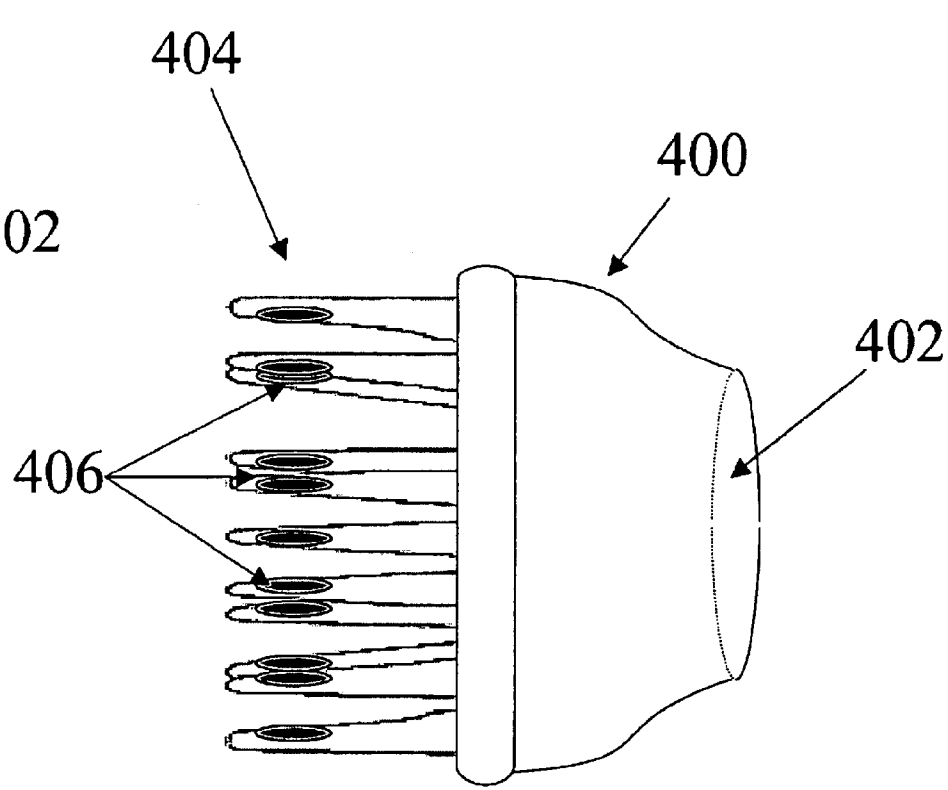
FIG. 4 illustrates an alternative attachment adapted for combination with the hair care appliance of FIG. 2.

With reference to FIG. 4, an alternative attachment adapted for combination with a hair care appliance according to the present invention is shown. The attachment shown in FIG. 4 is referred to as a volume diffuser 400, in which a connecting portion 402 is configured to releaseably attach to the air outlet of a hair care appliance. The volume diffuser 400 comprises a plurality of pins 404 having openings 406 on the distal ends respectively for directing the air from the hair care appliance to the roots of the hair and thereby drying at the roots of the hair. To provide far infrared radiation and negative ions, the volume diffuser 400 according to a preferred embodiment of the present invention is composed of the blended material described above and made by injection moulding or other suitable forming process.

It should be noted that the attachments shown in FIGS. 3 and 4 are for illustrative purpose only, modifications and variations of the attachment, such as styling brushes, volume picks, pulsators, massagers and other useful devices, may be made of the blended material according to the present invention for emitting far infrared radiation and negative ions during operation and are contemplated to fall within the scope of the present invention.

Figure 5:
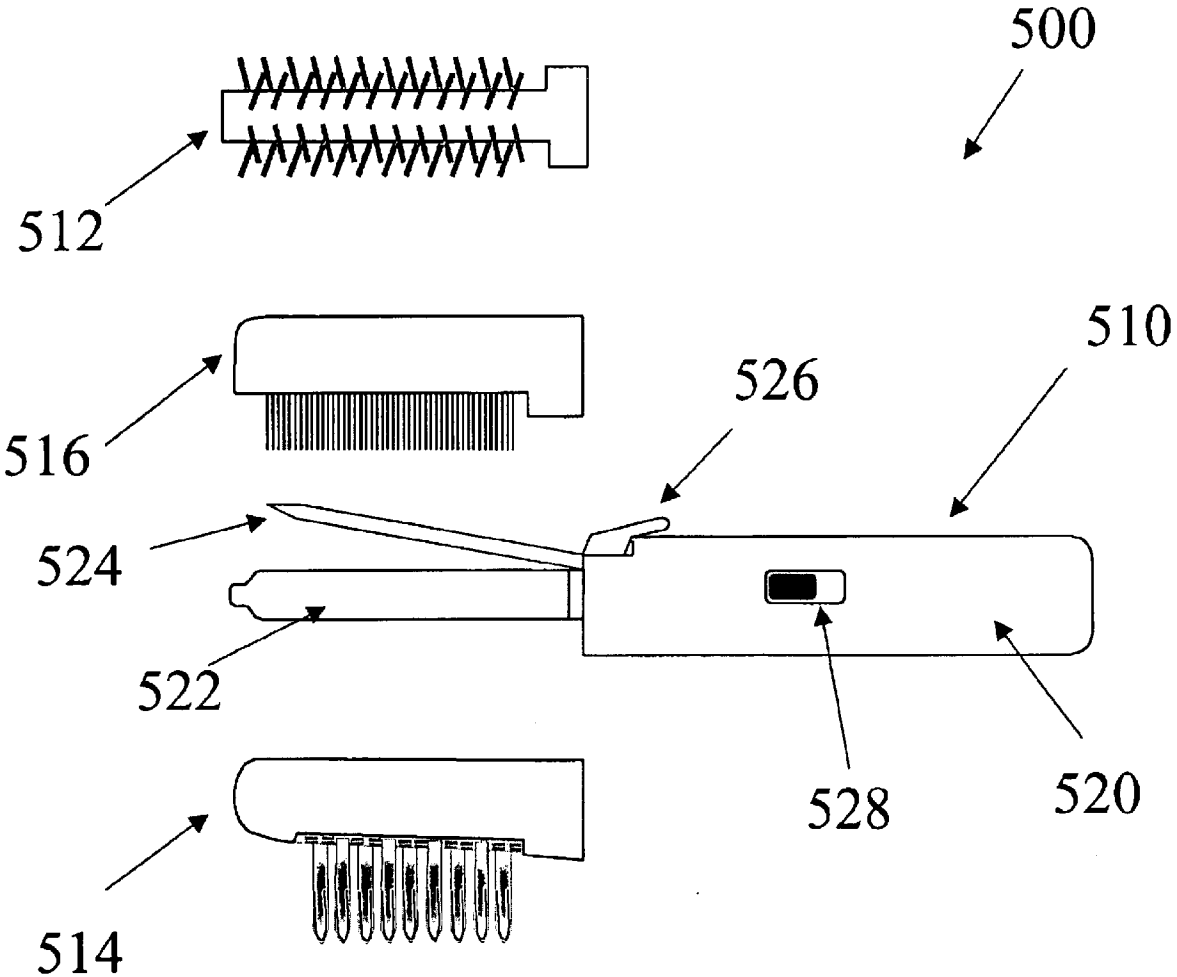
FIG. 5 illustrates a hair styler set according to a second embodiment of hair care appliance of the present invention.

According to a second embodiment of hair care appliance of the present invention, a hair styler set 500 is shown in FIG. 5. The hair styler set 500 comprises a curling iron 510 and a plurality of attachments, for example, round styling brush 512 for creating curls and waves, volume pick 514 for creating lift and volume at the hair roots, and straightening comb 516 for detangling, straightening and smoothing the hair.

The curling iron 510 comprises a handle 520 for gripping, a heating element 522, a hair clamp 524, a clamp lever 526 and a switch 528 for turning of or off the heating element 522. Since such curling iron 510 is well known in the art, the description and explanation thereof is omitted for simplicity. As to the attachments 512, 514 and 516 for the curling iron 510, each of the attachments includes a conductive (or inductive) heating element (not shown) therein so as to transfer the heat from the heating element 522 thereto as is well known to those skilled in this art. The attachments 512, 514 and 516 according to the present invention are made of the blended material described above such that far infrared radiation and negative ions can be emitted to the hair and scalp during hair styling.

It should be noted that the attachments 512, 514 and 516 shown in FIG. 5 are for illustrative purposes only, and modifications and variations of the attachments can be made of the blended material according to the present invention for emitting far infrared radiation and negative ions. In addition, the curling iron may use AC power through a power cord extending from the end of the handle 520 and connecting to a AC power source or use DC power through batteries contained therein. In another embodiment, the curling iron further includes a steam system for adding moisture back into the hair. However, the present invention is intended to cover all types of attachments made of blended materials according to the present invention which are applicable to all types of curling irons.

Figure 6B:
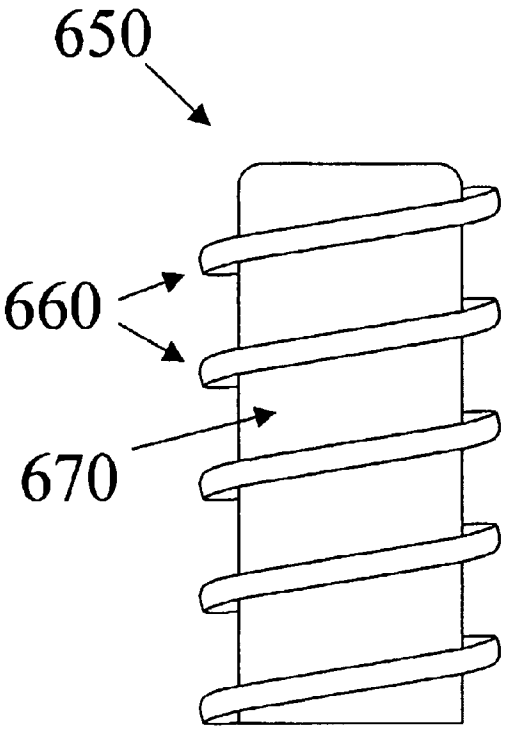
FIG. 6A and FIG. 6B illustrate a hair care appliance according to a third embodiment of the present invention.
Figure 6A:
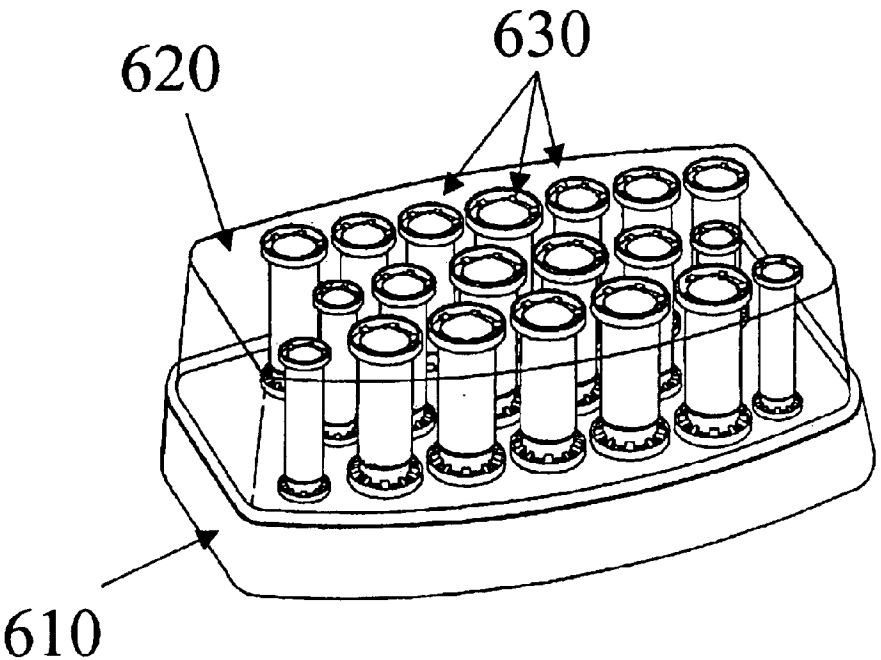

Furthermore, according to a third embodiment of the present invention, hair curling rollers are also constructed to emit far infrared radiation and negative ions. FIG. 6A shows a hair curling roller set 600 comprising a base 610 on which a plurality of upright rods (not shown) are disposed, a cover 620 and a plurality rollers 630 disposed onto said rods. In the case that the hair curling rollers are of the type having integral conductive or inductive heating elements, the rods can be heated to transfer the energy to the rollers for curling hair. Alternatively, if the hair curling rollers are not of the type which can be heated, the rods are utilized only for disposing and securing the rollers in place. With reference to FIG. 6B, an elevation view of a hair curling roller 650 is shown. The hair curling roller 650 has a hollow cylindrical configuration and corkscrew-like projections 660 are provided on the outer surface 670 of the hair curling roller 650 for placing a bundle of hair therebetween. According to the present invention, the curling roller 650 with the projections 660 provided thereon are made of the blended material described above by injection moulding so as to emit far infrared radiation and negative ions during hair curling.

Figure 7:
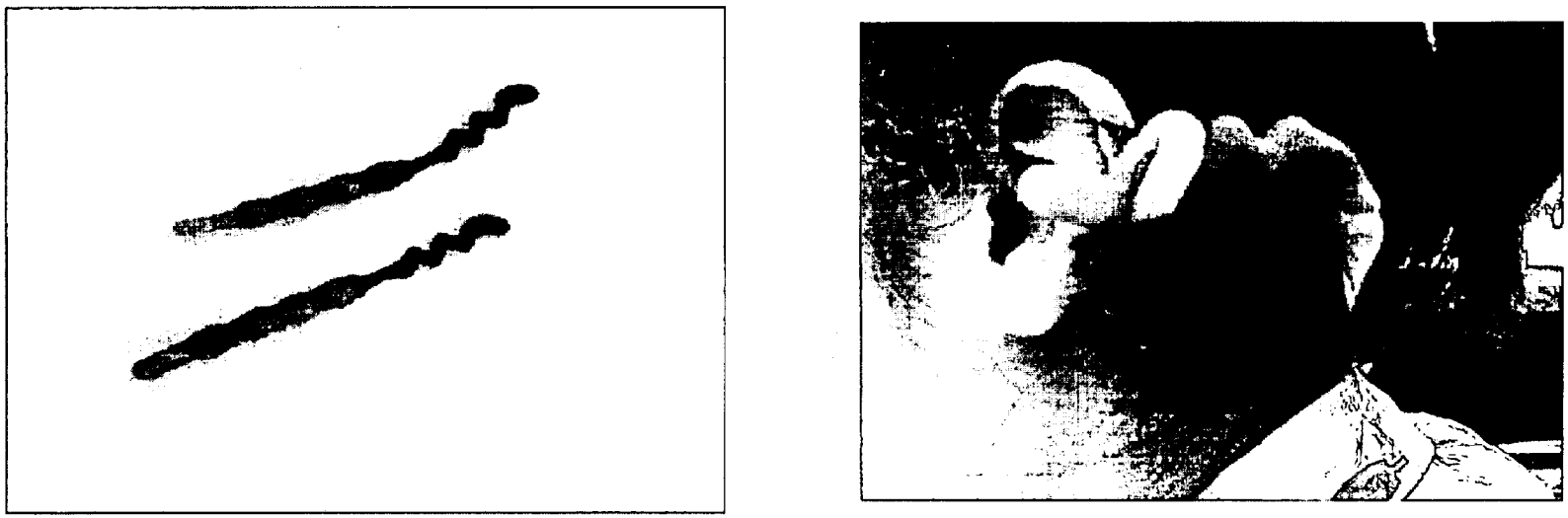
FIG. 7 illustrates a hair care appliance according to a fourth embodiment of the present invention.

It should be noted that both electric-heated type and non-heated type of hair curling rollers can be made of the blended material according to the present invention for providing far infrared radiation and negative ions. In addition, the configuration of the projections provided on the hair curling roller can be of any disposition, such as blank or brush-like configurations, for setting hair to different curls and waves. All such configurations are contemplated to fall within the scope of the present invention. Moreover, a hair setter strip, such as shown in FIG. 7, may also be made of the blended material according to the present invention such that far infrared radiation and negative ions can be emitted onto hair and scalp.

Although the preferred embodiments of the hair care appliances and attachments therefor according to the present invention have been disclosed, those skilled in the art will appreciate that various modification, additions and substitutions are possible. For example, attachments, such as soft-brush, for combination with an electric-facial cleaner and attachments for combination with massagers for muscle relief can be made of the blended material according to the present invention. In addition, hair arranging devices, such as combs and brushes, for adjusting, cleaning or confining hair can be made of the blended material according to the present invention for emitting far infrared radiation and negative ions. Therefore, the present invention is contemplated to cover all types of individual hair arranging devices, hair care appliance and attachments therefor and attachments for facial and body care appliances within the scope and spirit of the present invention as recited in the accompanying claims.

What is claimed is:

1. A hair curling roller comprising:

a hollow cylindrical shell, characterized in that a body of the cylindrical shell is entirely composed of a blended material of thermo-resistant material and ion-powders, wherein said ion-powders include a blend mixture of powders including anhydrous silicon ($SiO_2$), aluminum oxide ($Al_2O_3$), iron oxide ($Fe_2O_3$), titanium oxide ($TiO_2$), calcium oxide (CaO), magnesium oxide (MgO), potassium oxide ($K_2O$), sodium oxide ($Na_2O$) and manganese oxide (MnO), and wherein the size of the particles of said ion-powders is less than 10 $\mu$m in diameter; and a conductive heating element within the cylindrical shell.

2. A hair curling roller comprising:

a hollow cylindrical shell, characterized in that a body of the cylindrical shell entirely composed of a blended material of thermo-resistant material and ion-powders, wherein said ion-powders include a blend mixture of powders including anhydrous silicon ($SiO_2$), aluminum oxide ($Al_2O_3$), iron oxide ($Fe_2O_3$), titanium oxide ($TiO_2$), calcium oxide (CaO), magnesium oxide (MgO), potassium oxide ($K_2O$), sodium oxide ($Na_2O$) and manganese oxide (MnO), and wherein the size of the particles of said ion-powders is less than 10 $\mu$m in diameter; and an inductive heating element within the cylindrical shell.

3. A hair curling roller, comprising:

a hollow cylindrical shell, characterized in that the cylindrical shell is entirely composed of a blended material of thermo-resistant material and ion-powders;

wherein said ion-powders include at least a blend mixture of powders including anhydrous silicon ($SiO_2$), aluminum oxide ($Al_2O_3$), iron oxide ($Fe_2O_3$), titanium oxide ($TiO_2$), calcium oxide (CaO), magnesium oxide (MgO), potassium oxide ($K_2O$), sodium oxide ($Na_2O$) and manganese oxide (MnO), and wherein the size of the particles of said ion-powders is less than 10 $\mu$m in diameter; and an inductive heating element within the cylindrical shell, a plurality of projections disposed on an outer surface of the cylindrical shell, wherein the plurality of projections are integrally made of a blended material of thermo-resistant material and ion-powders.

4. A hair curling roller comprising:

a hollow cylindrical shell, characterized in that a body of the cylindrical shell is entirely composed of a blended material of thermo-resistant material and ion-powders, wherein said ion-powders include a blend mixture of powders including anhydrous silicon ($SiO_2$), aluminum oxide ($Al_2O_3$), iron oxide ($Fe_2O_3$), titanium oxide ($TiO_2$), calcium oxide (CaO), magnesium oxide (MgO), potassium oxide ($K_2O$), sodium oxide ($Na_2O$) and manganese oxide (MnO), wherein the size of the particles of said ion-powders is less than 10 $\mu$m in diameter; and an inductive heating element within the cylindrical shell wherein the body of said cylindrical shell includes a plurality of outer projections.

* * * * *